US009368263B2

(12) United States Patent
Kern et al.

(10) Patent No.: US 9,368,263 B2
(45) Date of Patent: Jun. 14, 2016

(54) MAGNET ASSEMBLY

(75) Inventors: Thorsten Alexander Kern, Alsbach (DE); Andreas Walther, Bruchköbel (DE)

(73) Assignee: Continental Automotive GmbH, Hannover (DE)

( * ) Notice: Subject to any disclaimer, the term of this patent is extended or adjusted under 35 U.S.C. 154(b) by 48 days.

(21) Appl. No.: 13/997,153

(22) PCT Filed: Dec. 21, 2011

(86) PCT No.: PCT/EP2011/073543

§ 371 (c)(1), (2), (4) Date: Dec. 10, 2013

(87) PCT Pub. No.: WO2012/085051

PCT Pub. Date: Jun. 28, 2012

(65) Prior Publication Data

US 2014/0210579 A1 Jul. 31, 2014

(30) Foreign Application Priority Data

Dec. 22, 2010 (DE) ..... 10 2010 055 481

(51) Int. Cl.
*H01F 1/00* (2006.01)
*H01F 7/02* (2006.01)

(52) U.S. Cl.
CPC ..... *H01F 7/021* (2013.01); *H01F 7/0221* (2013.01)

(58) Field of Classification Search
CPC ..... H01F 7/081; H01F 7/122; H01F 7/00; H01F 7/02; H01F 7/08; H01F 2007/086
USPC ..... 335/296
See application file for complete search history.

(56) References Cited

U.S. PATENT DOCUMENTS

| | | | | | |
|---|---|---|---|---|---|
| 3,238,485 | A | * | 3/1966 | Litchfield et al. | 336/198 |
| 3,790,889 | A | * | 2/1974 | Mincuzzi | 324/167 |
| 3,896,405 | A | * | 7/1975 | Pauli | 335/281 |
| 4,137,473 | A | * | 1/1979 | Pfister | 310/98 |
| 4,336,517 | A | * | 6/1982 | Kobayashi et al. | 335/205 |
| 4,677,409 | A | * | 6/1987 | Kozuka et al. | 335/258 |
| 5,046,377 | A | * | 9/1991 | Wilkes et al. | 74/431 |
| 5,251,659 | A | * | 10/1993 | Sturman et al. | 137/339 |
| 5,503,366 | A | * | 4/1996 | Zabeck et al. | 251/129.18 |

(Continued)

FOREIGN PATENT DOCUMENTS

| | | |
|---|---|---|
| DE | 44 16 172 A1 | 11/1995 |
| DE | 103 02 072 B3 | 9/2004 |

(Continued)

*Primary Examiner* — Shawki S Ismail
*Assistant Examiner* — Lisa Homza
(74) *Attorney, Agent, or Firm* — Cozen O'Connor

(57) ABSTRACT

A magnet assembly, having a disk-shaped magnet, which is made predominantly of metal material and has a through-hole and, by the through-hole, can be placed onto a region of a shaft made of plastic by a press fit. In the region of the magnet placed onto the shaft, the shaft has a diameter that is smaller than the diameter of the through-hole. The shaft has a plurality of radially protruding projections in the region of the magnet placed onto the shaft. The projections are distributed evenly on the circumference of the shaft and, with respect to the longitudinal axis of the shaft, having a radius, the double of which is oversized relative to the diameter of the through-hole before the magnet is placed onto the projections of the shaft.

9 Claims, 3 Drawing Sheets

(56) References Cited

U.S. PATENT DOCUMENTS

| | | | | |
|---|---|---|---|---|
| 5,543,672 | A * | 8/1996 | Nishitani et al. | 310/77 |
| 5,563,463 | A * | 10/1996 | Stark | 310/156.28 |
| 5,703,419 | A * | 12/1997 | Mizutani | 310/49.33 |
| 5,820,100 | A * | 10/1998 | Fontaine et al. | 251/129.16 |
| 6,003,839 | A * | 12/1999 | Kobayashi | 251/129.15 |
| 6,013,961 | A * | 1/2000 | Sakamaki et al. | 310/68 B |
| 6,198,185 | B1 | 3/2001 | Bruhn et al. | |
| 6,305,583 | B1 * | 10/2001 | Ward et al. | 222/504 |
| 6,318,703 | B1 * | 11/2001 | Goossens et al. | 251/129.15 |
| 6,364,084 | B1 * | 4/2002 | Boyer et al. | 192/84.961 |
| 6,759,934 | B2 * | 7/2004 | Bircann et al. | 335/255 |
| 7,240,576 | B1 * | 7/2007 | Perry | 73/866.5 |
| 7,243,899 | B2 * | 7/2007 | Acar et al. | 251/129.07 |
| 7,557,684 | B2 * | 7/2009 | Kurasawa | 335/281 |
| 7,575,218 | B2 * | 8/2009 | Speer et al. | 251/129.02 |
| 7,777,603 | B2 * | 8/2010 | Bamber et al. | 335/279 |
| 7,825,758 | B2 * | 11/2010 | Bamber | 335/220 |
| 7,871,060 | B2 * | 1/2011 | Armour | 251/129.15 |
| 7,932,796 | B2 * | 4/2011 | Yamada et al. | 335/205 |
| 7,992,839 | B2 * | 8/2011 | Nordstrom et al. | 251/129.15 |
| 8,212,640 | B1 * | 7/2012 | Tuschner | 335/229 |
| 8,282,072 | B2 * | 10/2012 | Kratzer | 251/129.15 |
| 8,451,080 | B2 * | 5/2013 | Lee et al. | 335/281 |
| 8,456,262 | B2 * | 6/2013 | Kondo | 335/220 |
| 8,736,128 | B2 * | 5/2014 | Dede et al. | 310/191 |
| 8,736,136 | B2 * | 5/2014 | Lee et al. | 310/216.075 |
| 2002/0029949 | A1 * | 3/2002 | Kawada et al. | 192/84.961 |
| 2006/0255664 | A1 * | 11/2006 | Kraus et al. | 310/36 |
| 2006/0255665 | A1 * | 11/2006 | Kraus et al. | 310/36 |
| 2008/0257655 | A1 * | 10/2008 | Ito et al. | 187/406 |
| 2009/0256092 | A1 * | 10/2009 | Nordstrom et al. | 251/129.15 |

FOREIGN PATENT DOCUMENTS

| | | | |
|---|---|---|---|
| DE | 103 31 961 | A1 | 2/2005 |
| DE | 20 2008 000 822 | U1 | 5/2009 |
| EP | 0 902 880 | B1 | 10/2002 |
| FR | 2 774 227 | A1 | 7/1999 |

* cited by examiner

MAGNET ASSEMBLY

CROSS REFERENCE TO RELATED APPLICATIONS

This is a U.S. national stage of application No. PCT/EP2011/073543, filed on Dec. 21, 2011. Priority is claimed on German Application No. DE102010055481.2 filed Dec. 22, 2010; the content of which is incorporated here by reference.

BACKGROUND OF THE INVENTION

1. Field of the Invention

The invention relates to a magnet assembly with a disk-shaped magnet of predominantly metallic material, which has a through-hole by which through-hole the magnet assembly can be placed on a region of a shaft plastic by a press fit.

2. Description of Prior Art

Due to the brittle nature of the magnet material, when the magnet is pressed onto the shaft, the magnet can split open.

This risk also persists over the life of the magnet assembly due to ageing and embrittlement of the magnet material.

The magnet can also split open due to a temperature rise due to the substantially higher expansion coefficient of the shaft material in comparison with the magnet material.

Furthermore the holding force of the magnet on the shaft can be reduced by a creeping of the plastic material of the shaft, in particular over the life of the magnet assembly.

SUMMARY OF THE INVENTION

An object of one embodiment of the invention is a magnet assembly of the type cited initially that can be produced economically and allows a permanently firm arrangement of the magnet on the shaft with no risk of the magnet splitting open.

According to one embodiment of the invention, in the region of the applied magnet, the shaft has a diameter that is smaller than the diameter of the through-hole, and that in the region of the applied magnet, the shaft is formed with a multiplicity of radially projecting protrusions arranged evenly distributed on the circumference of the shaft and with respect to the longitudinal axis of the shaft have a radius, the double of the radius of the protrusions is oversized in relation to the diameter of the through-hole before application of the magnet on the protrusions of the shaft.

Since there is no need for tight tolerance, but only for rough tolerance of the diameter of the through-hole of the magnet and of the radius in the region of the protrusions, the magnet assembly can be produced economically.

The cavities between the radially projecting protrusions, into which the excess material of the protrusions can creep both on assembly of the magnet and over the life of the magnet assembly, ensure a permanently firm seat of the magnet on the shaft without the magnet splitting open due to a temperature rise.

In relation to the fit by which the magnet sits on the shaft, the spacing between the contact surface of the protrusions and the contact surface of the through-hole that exists before the joining of the two parts is oversized when the actual radial dimension of the shaft at the protrusions is greater than that of the through-hole.

Ease of production by simple removal of the shaft from the mold is achieved if the protrusions are webs that extend parallel to the longitudinal axis of the shaft.

If the webs extend axially out of the through-hole of the magnet on one or both sides, the plastic material of the webs creeps axially out of the opening(s) of the through-hole, radially towards the outside by a specific amount.

Thus axial stops are produced which axially secure the magnet against slipping on the shaft by a form-fit connection.

A particularly concentric arrangement of the magnet on the shaft is achieved if the shaft is formed with an odd number of webs, wherein the shaft can be formed with three webs which extend between 20° and 60°, in particular by 40°, in the circumferential direction.

This extension of the webs in the circumferential direction ensures a volume between the webs sufficient to receive the creeping material of the shaft.

For easy assembly into the nominal position of the magnet on the shaft, the shaft can have a radially protruding stop shoulder at one axial end of the region formed with the protrusions, and the magnet can be placed on the shaft until it rests on the stop shoulder.

If at the end opposite the stop shoulder, the webs run out in the manner of a ramp to the cylindrical casing surface of the shaft, no stops are formed at this end which could hinder the application of the magnet and where applicable lead to chipping of the webs, since by its through-hole the magnet slides over the ramps onto the webs.

The shaft can be formed as a worm screw shaft in a region spaced axially from the region of the protrusions.

Because of the fixed arrangement of the magnet on the shaft, the torques transmitted by the worm screw shaft do not lead to a relative twist of the magnet on the shaft.

BRIEF DESCRIPTION OF THE DRAWINGS

One exemplary embodiment of the invention is shown in the drawing and described in more detail below. In the drawings.

DETAILED DESCRIPTION OF THE PREFERRED EMBODIMENTS

Figure 1:
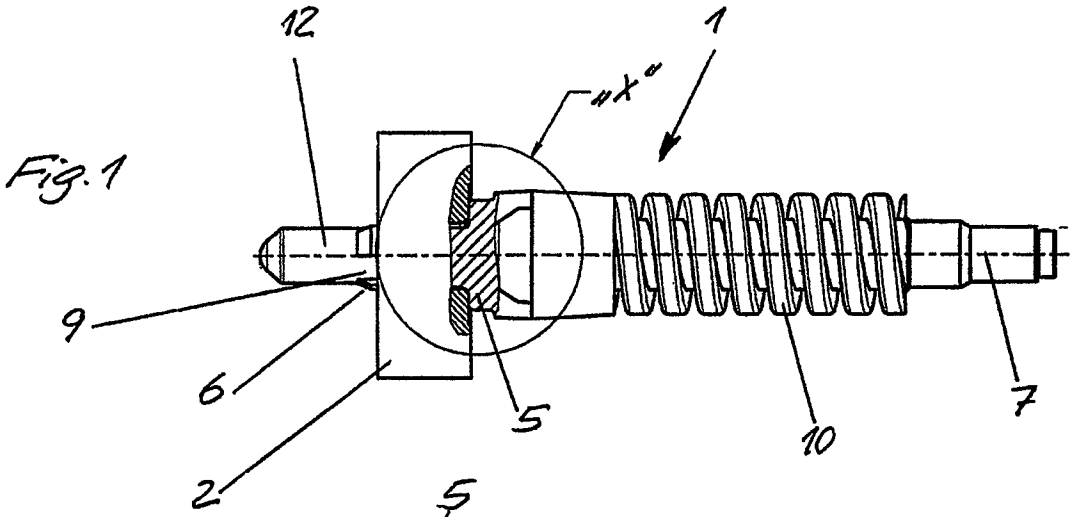
FIG. 1 is a side view of a magnet assembly.

The magnet assembly shown in FIG. 1 has a shaft 1 of plastic on which, in an end region 12 of the shaft 1, a magnet 2 is placed by a press fit, which magnet 2 is formed as a permanent magnet and has a through-hole 3 and consists predominantly of a metallic material.

The shaft 1 in the end region 12 has a diameter which is smaller than the diameter of the through-hole 3 of the magnet 2.

Figure 3:
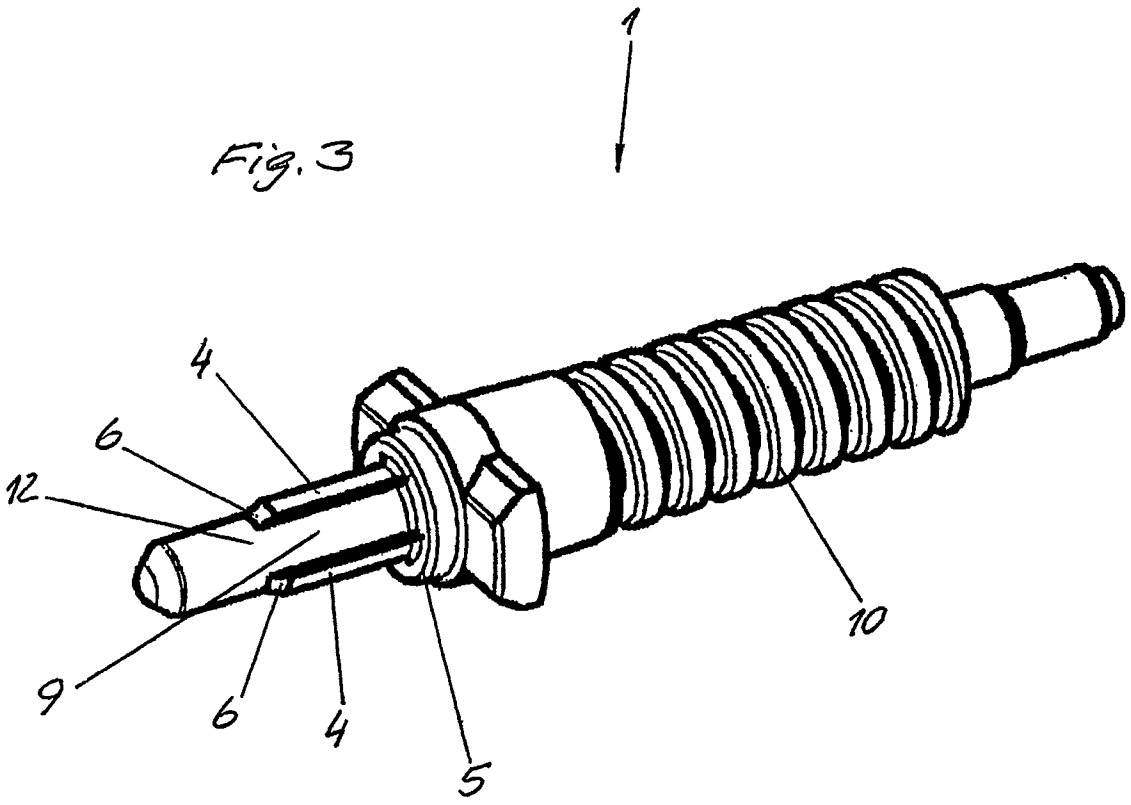
FIG. 3 is a perspective view of a shaft of the magnet assembly in FIG. 1.

In the region of the shaft 1 in which the disk-shaped magnet is applied, the shaft 1 is formed with three radially projecting webs 4 (FIGS. 3-5) which extend parallel to the longitudinal axis 7 of the shaft and are evenly distributed over the circumference of the shaft 1 and extend up to a radially protruding stop shoulder 5 of the shaft 1.

The length of the webs 4 is greater than the axial length of the magnet 2 so that they protrude out of the through-hole 3.

At their end 6 opposite the stop shoulder 5, the webs 4 run out in the manner of a ramp to the cylindrical casing surface of the end region 12 of the shaft 1.

Figure 5:
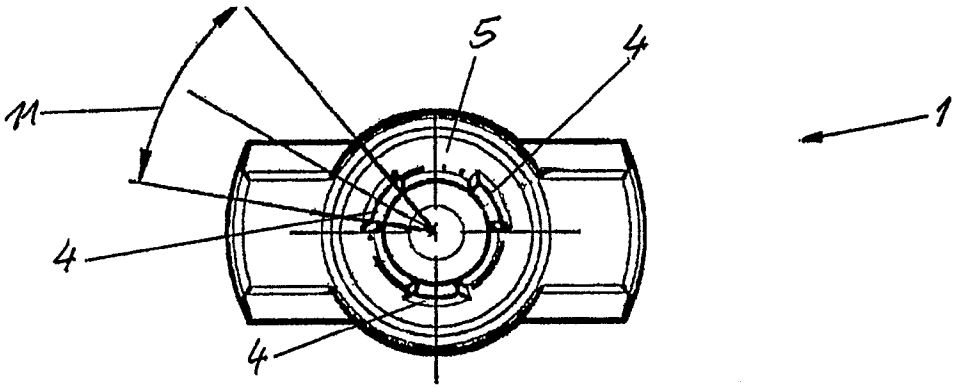
FIG. 5 is a front view of the shaft of the magnet assembly in FIG. 1.

Each of the webs 4 extends through an angle 11 of 40° in the circumferential direction (FIG. 5).

Figure 4:
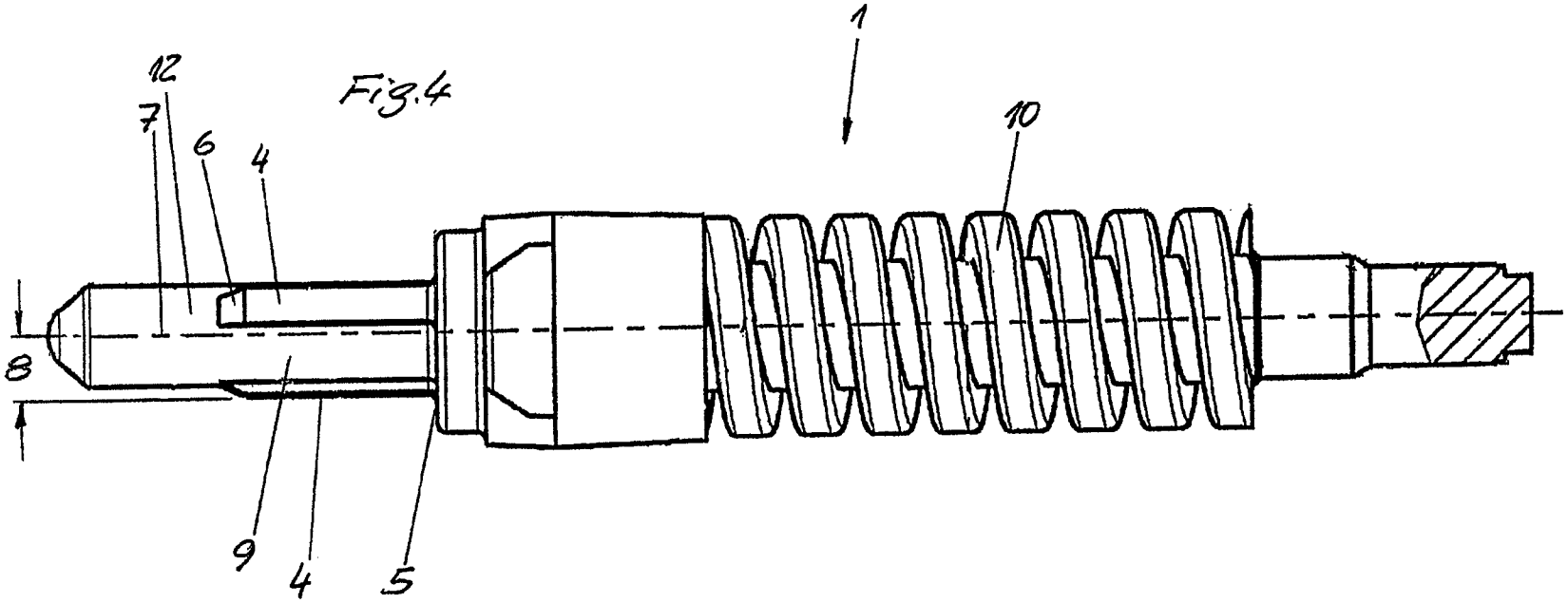
FIG. 4 is a side view of the shaft of the magnet assembly in FIG. 1.

Before the magnet 2 is placed on the shaft 1, in relation to the longitudinal axis 7 of the shaft, twice the radius 8 of the webs 4 is oversized in relation to the diameter of the through-hole 3 (FIG. 4).

As an example of the order of magnitude, the oversize for a diameter of the through-hole 3 of 1.35±0.015 mm can be greater than 8/100 mm.

Figure 2:
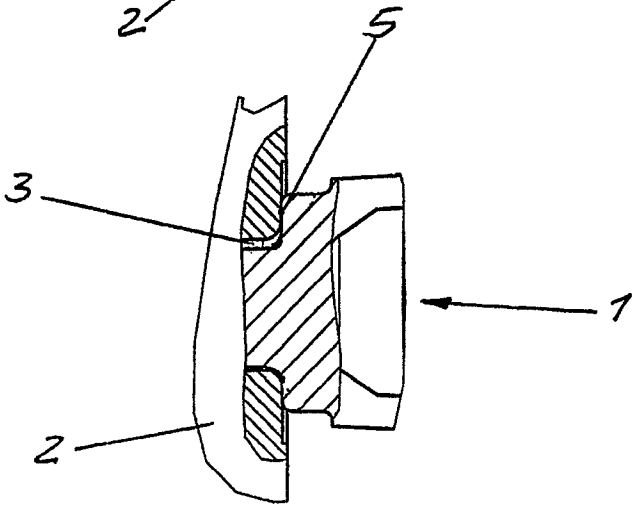
FIG. 2 is an enlarged extract "X" from the magnet assembly in FIG. 1.

If by its through-hole 3 the magnet 2 is pushed onto the webs 4 until it rests on the stop shoulder 5, the excess material of the webs 4 creeps into the cavities 9 between the webs 4 so that the magnet 2 sits firmly on the shaft 1 in the region of the webs 4 but is not exposed to any radial stress which could lead to bursting of the magnet 2 (FIGS. 1,2).

At the ends 6 of the webs 4 protruding from the through-hole 3, the webs 4 have a radial curvature whereby the magnet 2 is axially secured in its fitting position.

On the side of the stop shoulder 5 facing away from the webs 4, the shaft 1 is formed as a worm screw shaft 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A magnet assembly comprising:

a shaft having a longitudinal axis; and a disk-shaped magnet of a metallic material having a through-hole by which the disk-shaped magnet is placed on the shaft by a press fit in an applied region of the shaft, wherein in the applied region, the shaft has a diameter smaller than a diameter of the through-hole, and wherein in the applied region of the shaft, the shaft has a plurality of radially projecting protrusions that are arranged evenly distributed on a circumference of the shaft with respect to the longitudinal axis of the shaft, each radially projecting protrusion runs out in a ramp to a cylindrical surface of the shaft towards a longitudinal end of the shaft, each protrusion having a radius, twice the radius of each protrusion being oversized with respect to a diameter of the through-hole before application of the disk-shaped magnet on the plurality of radially projecting protrusions of the shaft, wherein cavities between the radially projecting protrusions are at least partially filled with material of the protrusions during assembly of the magnet on the shaft.

2. The magnet assembly as claimed in claim 1, wherein each radially projecting protrusion is a web that extends parallel to the longitudinal axis of the shaft.

3. The magnet assembly as claimed in claim 2, wherein the webs extend axially out of the through-hole of the disk-shaped magnet at least one side.

4. The magnet assembly as claimed in claim 3, wherein the shaft is formed with an odd number of webs.

5. The magnet assembly as claimed in claim 2, wherein the shaft has an odd number of webs.

6. The magnet assembly as claimed in claim 5, wherein the shaft has three webs that extend between 20° and 60° in a circumferential direction of the shaft.

7. The magnet assembly as claimed in claim 5, wherein the webs extend over 40° in a circumferential direction of the shaft.

8. The magnet assembly as claimed in claim 2, wherein the shaft has a radially protruding stop shoulder at one axial end of the applied region formed with the plurality of radially projecting protrusions, and the disk-shaped magnet is configured to be pressed onto the shaft until it rests on the radially protruding stop shoulder.

9. The magnet assembly as claimed in claim 1, wherein the shaft is formed as a worm screw shaft in a region axially spaced from the region of the plurality of radially projecting protrusions.

* * * * *